US006659033B1

(12) United States Patent
Donley

(10) Patent No.: US 6,659,033 B1
(45) Date of Patent: Dec. 9, 2003

(54) MOORING DEVICE AND METHOD

(76) Inventor: G. Russell Donley, 148 Herronwood Dr., Graham, NC (US) 27253

( * ) Notice: Subject to any disclaimer, the term of this patent is extended or adjusted under 35 U.S.C. 154(b) by 0 days.

(21) Appl. No.: 10/224,128

(22) Filed: Aug. 20, 2002

(51) Int. Cl.[7] ..... B63B 21/00
(52) U.S. Cl. ..... 114/230.15; 114/230.2
(58) Field of Search ..... 114/230.1, 230.16, 114/230.2, 230.26, 230.11, 230.15

(56) References Cited

U.S. PATENT DOCUMENTS 3,094,755 A * 6/1963 Casanave ..... 24/129 R
3,863,591 A * 2/1975 Wild ..... 114/230.26
5,398,634 A * 3/1995 Eagan ..... 114/230.1
5,586,514 A * 12/1996 Yuscavage ..... 114/230.26
5,832,861 A * 11/1998 Taylor ..... 114/230.26

OTHER PUBLICATIONS

Overton's Discount Boating Accessories vol. 2001–#1B pp. 78,79,82,83.

* cited by examiner

*Primary Examiner*—Stephen Avila

(57) ABSTRACT

A mooring device and method for small boats is provided which allows a boat to be quickly, securely moored to a dock. The mooring device comprises a rigid tubular member having a Y-like shape. An endless cord passes through the tubular member and exits both arms and the leg of the Y-like member to secure small boats safely while accommodating waves of up to approximately two feet in height.

14 Claims, 7 Drawing Sheets

MOORING DEVICE AND METHOD

FIELD OF THE INVENTION

The invention herein pertains to mooring small boats and particularly pertains to mooring boats to a wooden dock such as at a lake or beach.

DESCRIPTION OF THE PRIOR ART AND OBJECTIVES OF THE INVENTION

Small fishing boats and pleasure craft have been moored in many ways throughout the years, generally with one or two ropes used to tie the boat alongside the dock. Dock cleats and other attaching methods have been used in the past with varying degrees of success. Under ideal conditions most securing methods work, however during storms or other adverse weather conditions conventional securing methods often fail, causing the boat to become free or be damaged as they strike the dock or adjoining boats.

Thus, based on the problems and disadvantages of conventional mooring devices and methods, the present invention was conceived and one of its objectives is to provide a mooring device and method which will maintain the boat at a safe, secure distance from the dock under bad weather conditions.

It is another objective of the present invention to provide an inexpensive mooring device which will allow a moored boat to safely accommodate wakes or tidal changes of up to approximately two feet in height.

It is still another objective of the present invention to provide a portable, easily removably mooring device which will easily work on virtually any wooden dock.

It is yet another objective of the present invention to provide a method for quickly and efficiently mooring the boat at two points along a wooden dock with little practice or training required.

Various other objectives and advantages of the present invention will become apparent to those skilled in the art as a more detailed description is set forth below.

SUMMARY OF THE INVENTION

The aforesaid and other objectives are realized by providing a pair of mooring devices, each formed from a tubular member having a Y-like shape. An endless cord is contained within the tubular member and trio of end caps provide pairs of apertures to allow the endless cord to exit through the end caps. Releasable brackets in the preferred form of the mooring device are affixed to each of the cords as they exit both arms of the tubular member for securing the mooring device between boards of a wooden dock. The leg of the mooring device is telescopically adjustable as it contains a slidable section therein having holes which align with holes in the leg member. A locking pin secures the slidable section in a desired position within the leg. A split bolt is movably positioned on the endless cord as it exits the end cap of the slidable section. The split bolt is used to tighten the cord, for example to a boat cleat during mooring. Cushions are positioned on each of the arms and the leg to allow the mooring device to float in the event that it inadvertently falls into the water.

The method as described herein includes the step of affixing the releasable brackets to the dock, such as between dock boards in the preferred method and thereafter adjusting the length of the leg with the slidable section to accommodate the specific boat to maintain it in a desired spacial relation to the dock. Next, the endless cord which exits the slidable section end cap is wrapped around the boat cleat and is secured thereon by using the split bolt by sliding it into tight frictional engagement along the cord. The method steps as explained are reversed when it is desired to remove the mooring devices so the boat can be used or otherwise moved from the dock.

In an alternate method of attaching the mooring device to a dock, a connector is attached, such as by lag screws to a private dock. Pins which are removable engage the cord as it exits the arm of the Y-like member to secure the mooring device.

DETAILED DESCRIPTION OF THE PREFERRED EMBODIMENTS AND OPERATION OF THE INVENTION

Figure 1:
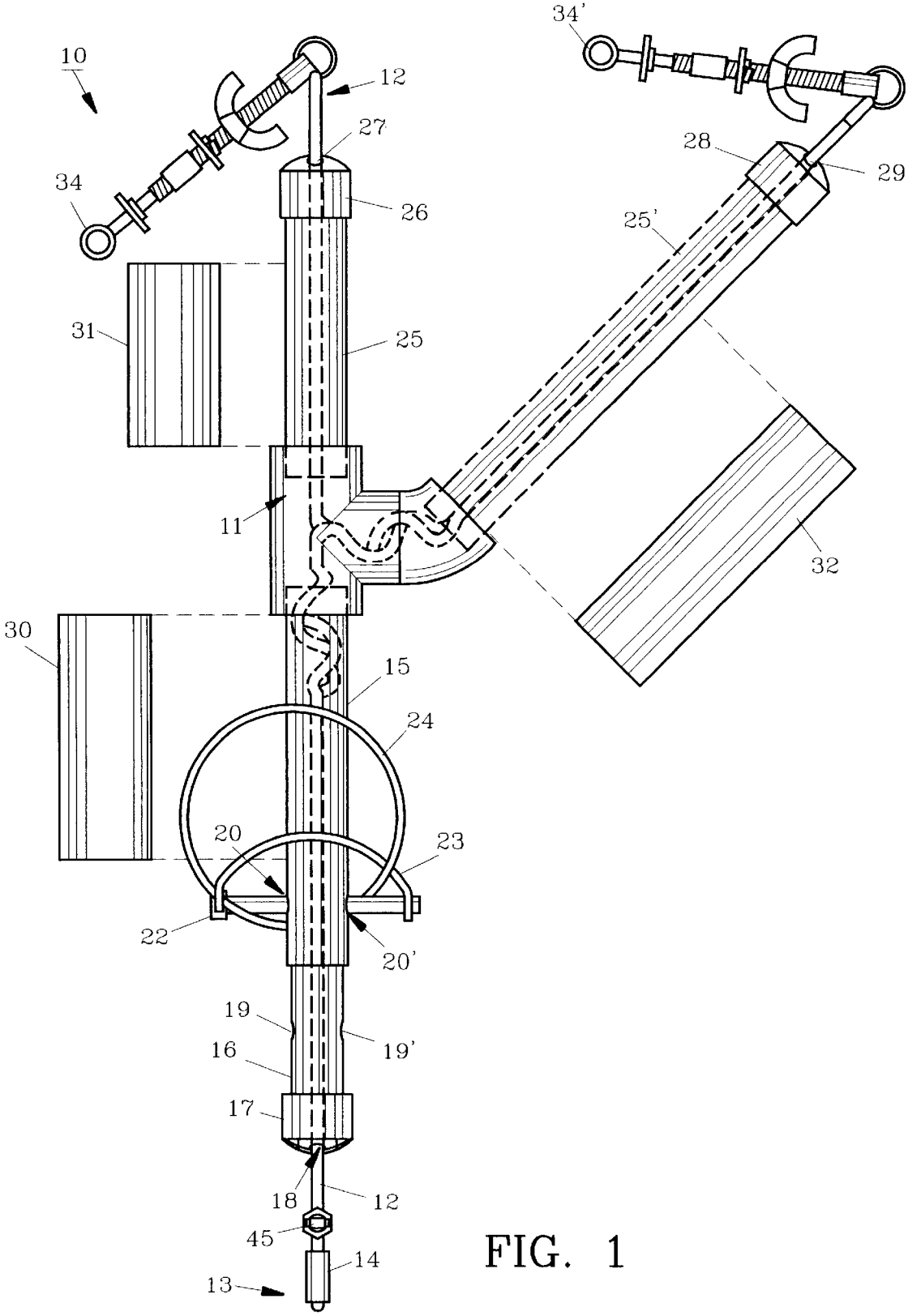
FIG. 1 demonstrates the preferred form of the mooring device herein in partial exploded fashion.
Figure 2:
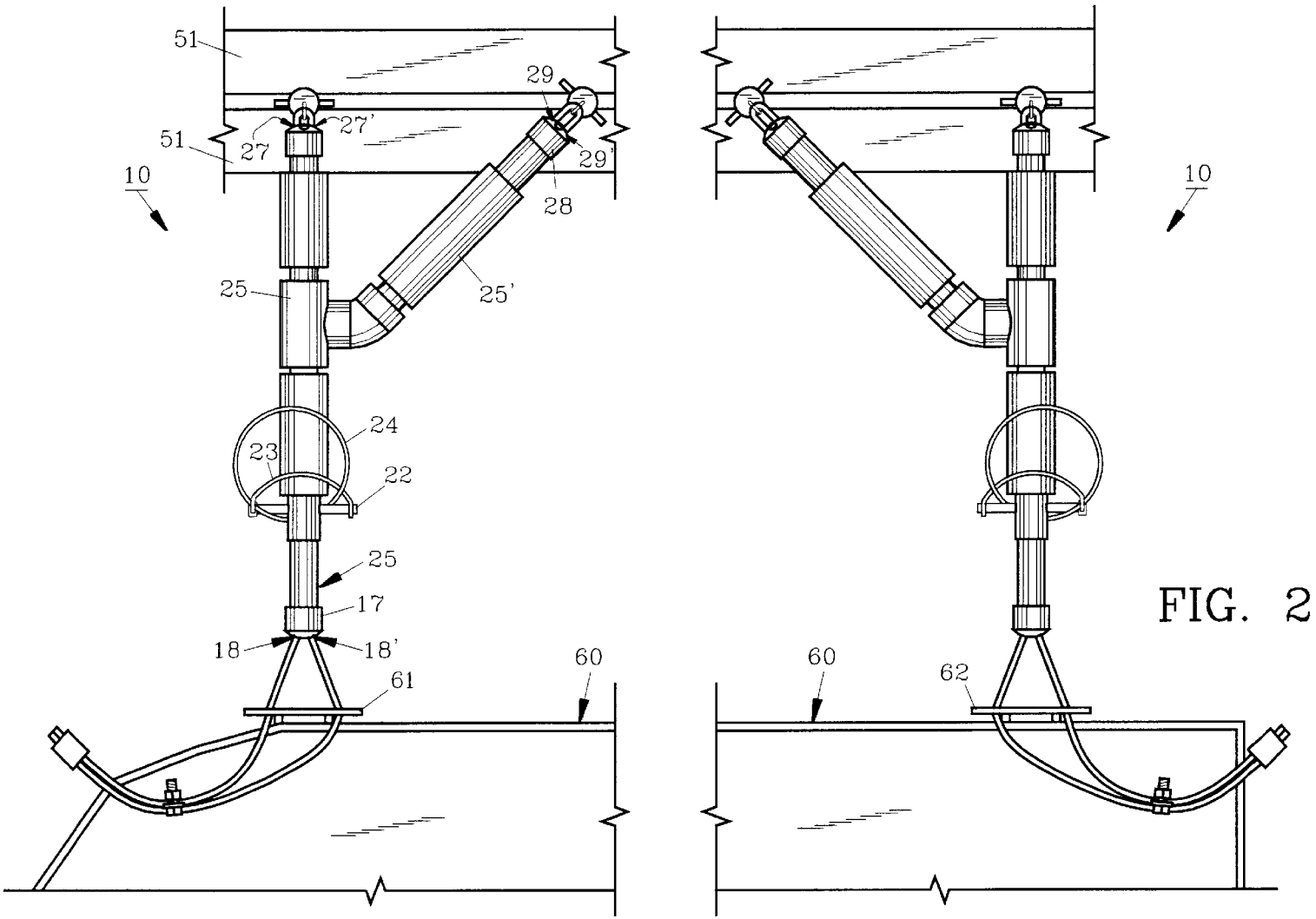
FIG. 2 Illustrates the use of the mooring device on a typical fishing boat using the releasable brackets.

For a better understanding of the invention and its method of use, turning now to the drawings, FIG. 1 demonstrates preferred mooring device 10 consisting of a rigid polmeric tubular member 11 made from standard PVC pipe containing endless nylon cord 12. Conventional cord 12 may have a diameter of approximately 7–8 mm and is suitable for use on boats and for other wet environments. Cord 12 is endless, that is it is fastened together at its proximal end 13 with standard metal clamp 14 or the like and is contained within tubular member 11 with excessive length. The excessive cord length allows leg 15 of tubular member 11 to extend as required by adjustment through telescopic movement of slidable tubular section 16 which is positioned within leg 15. Section 16 has cap 17 affixed thereto which defines a pair of openings 18, 18' (FIG. 2) to allow cord 12 to exit therefrom. Section 16 defines a series of holes 19, 19' along each side for adjustment purposes. Once a selected hole 19 of section 16 is aligned with desired holes 20, 20' in leg 15, standard locking pin 22 is inserted and lock clip 23 is then positioned over the end of locking pin 22 as shown in FIG. 2 which maintains locking pin 22 in place. If the length of tubular member 11 (leg 15) requires further adjustment, lock clip 23 is removed from the end of locking pin 22, pin 22 is removed from leg 15 and section 16 is then realigned in leg 15 and secured again with locking pin 22 as described above. Safety loop 24 formed from a plastic line prevents locking pin 22 from being lost or being dropped into the water. Loop 24 is affixed to locking pin 22 and is placed around leg 15.

Tubular member 11 also includes arms 25, 25' which along with leg 15, provides tubular member 11 with a Y-like appearance. Cord 12 exits leg 15 through end cap 17 which defines openings 18, 18' (FIG. 2) and exits arm 25 through end cap 26 which defines openings 27, 27' for cord 12 to pass therethrough. Likewise cord 12 passes through openings 29, 29' (FIG. 2) on end cap 28 of arm 25' as shown in FIG. 1.

Polymeric foam cushion 30 as shown in FIG. 1 is positioned on leg 15 whereas cushion 31 is positioned on arm 25 and cushion 32 is positioned on arm 25'. Cushions 30, 31, 32 are manufactured from a durable polymeric foam such as polyurethane, nylon or the like and may be secured thereto with typical band fasteners, adhesives or other standard fasteners. Cushions 30, 31, 32 are used for flotation purpose in the event mooring device 10 falls into the water; as may inadvertently occur.

Figure 4:
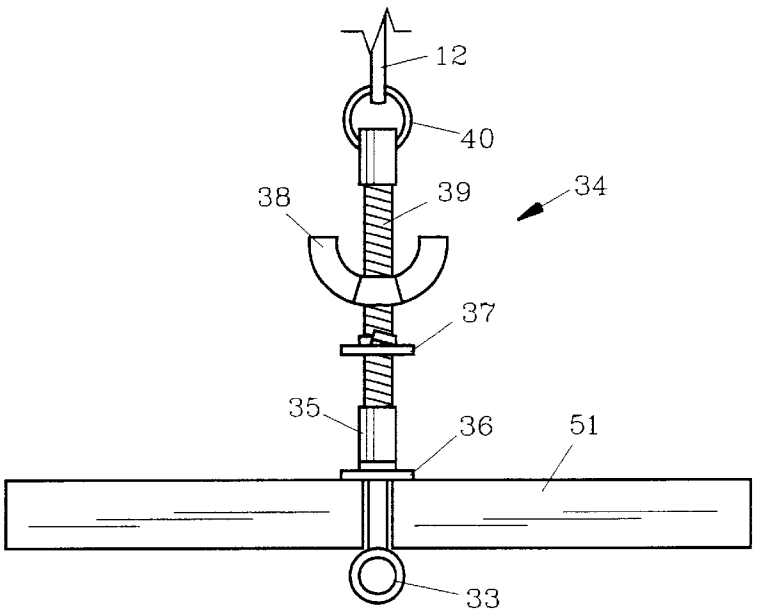
FIG. 4 depicts the releasable bracket of the mooring device as attach between dock boards.

In FIG. 2, a typical boat dock 50 is shown having a series of dock boards 51 with brackets 34 mounted thereto as also shown in FIG. 4. Mooring devices 10 are joined to standard cleats 61, 62 of boat 60 by securing endless cord 12 thereto which exits end cap 17.

Figure 3:
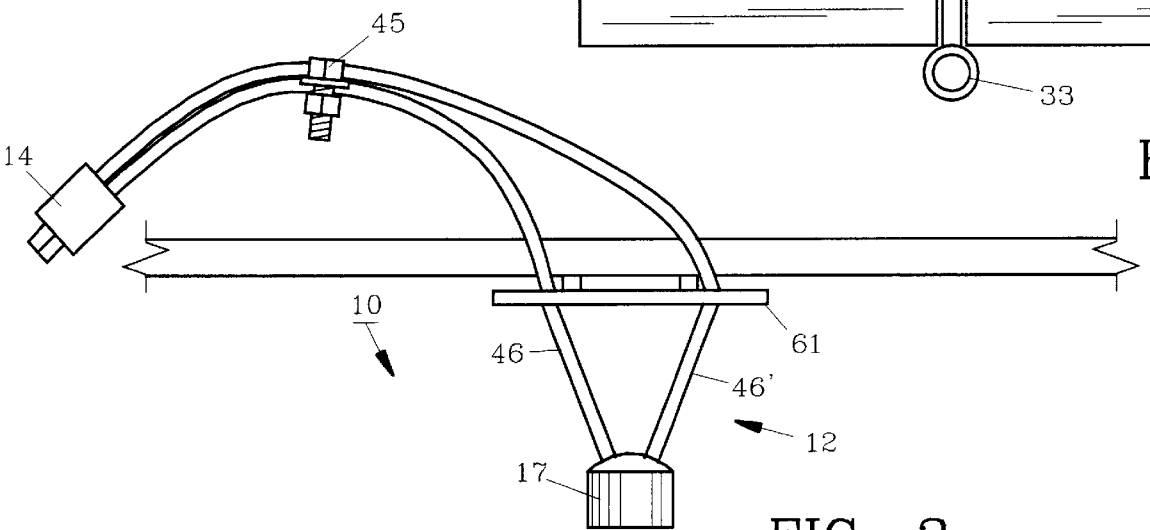
FIG. 3 shows an enlarged proximal end of the mooring device as attached to a boat cleat.

FIG. 3 shows mooring device 10 in enlarged fragmented fashion with cord 12 secured to boat cleat 61 as split bolt 45 has been urged toward cleat 61 to tighten cord strands 46, 46' exiting end cap 17 into tight engagement around cleat 61. Conventional split bolt 45 is then tightened by rotation until removal is desired.

As further shown in FIG. 4 the method of affixing releasable bracket 34 for mooring is as follows: loop 33 of releasable bracket 34 is passed through the space between dock boards 51 as also shown in FIG. 3 whereafter loop 33 is rotated ninety degrees to prevent inadvertent removal of loop 33. Next, spacer 35 engages step washer 36 as wing nut 38 is rotated downwardly along threaded shaft 39 to thereby engage upper washer 37 which then presses spacer 35 downwardly. As wing nut 38 is tightened (moved downwardly) loop 33 is urged upwardly to thereby sandwich dock board 51 between loop 33 and step washer 36. Bracket ring 40 contains cord 12 for mooring boat 60 as seen in FIG. 4. To remove mooring device 10 from dock 50, wing nut 38 is loosened, loop 33 rotated ninety degrees and can then be pulled upwardly between dock boards 51 to free releasable bracket 34.

Figure 5:
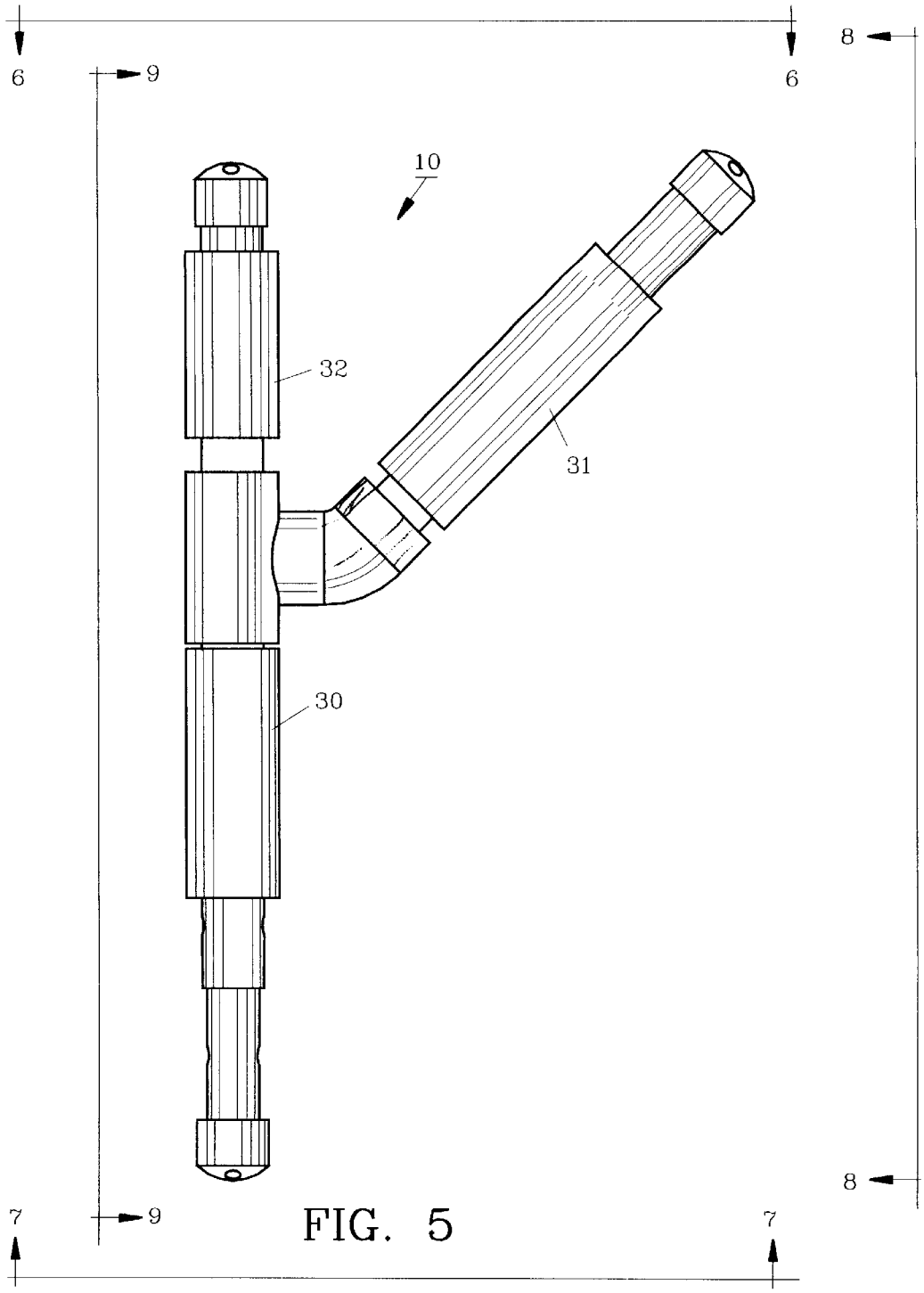
FIG. 5 shows the mooring device as seen in FIG. 1 with the cord and releasable bracket removed.

In FIG. 5, a top view of mooring device 10 is shown with resilient cushions 30, 31, 32 in place thereon and without endless cord 12, releasable brackets 34, 34' or locking pin 22 shown.

Figure 6:
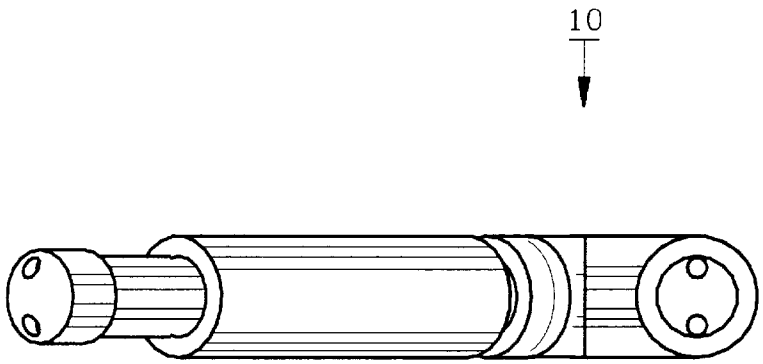
FIG. 6 features a view of the distal end of the releasable bracket as seen in FIG. 5 along lines 6—6.
Figure 7:
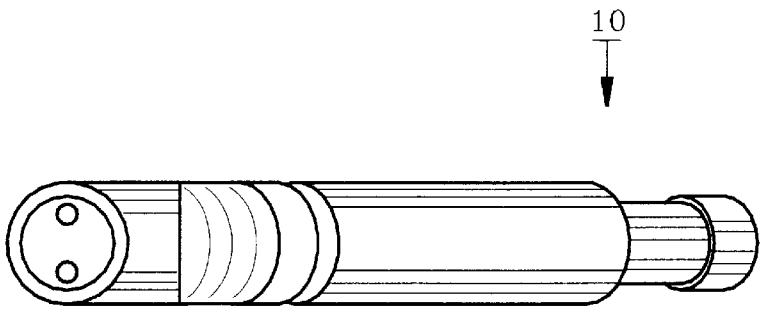
FIG. 7 demonstrates the proximal end of the mooring device of FIG. 5 along lines 7—7.
Figure 9:
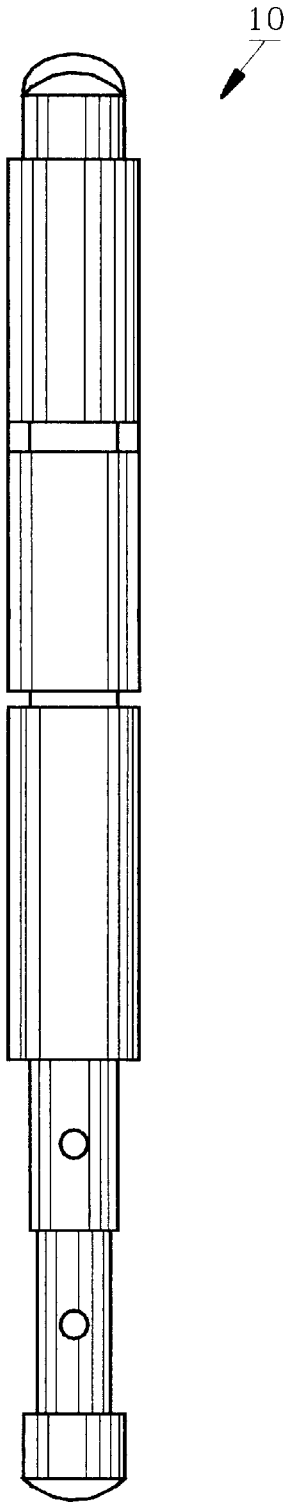
FIG. 9 depicts the mooring bracket of FIG. 5 in elevational view along the left side thereof.
Figure 8:
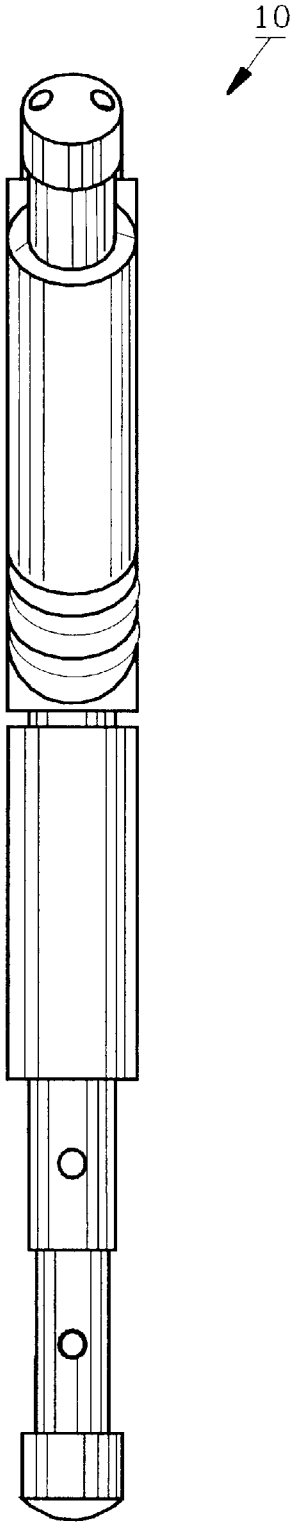
FIG. 8 pictures an elevational view of the mooring device of FIG. 5 along the right side.

In FIG. 6, a distal (dock) end view of mooring device 10 is seen whereas in FIG. 7 a proximal (boat) end view of mooring device 10 is shown. In FIG. 8 a left side elevational view of mooring device 10 is seen whereas in FIG. 9 a right side elevational view of mooring device 10 is provided.

Figure 10:
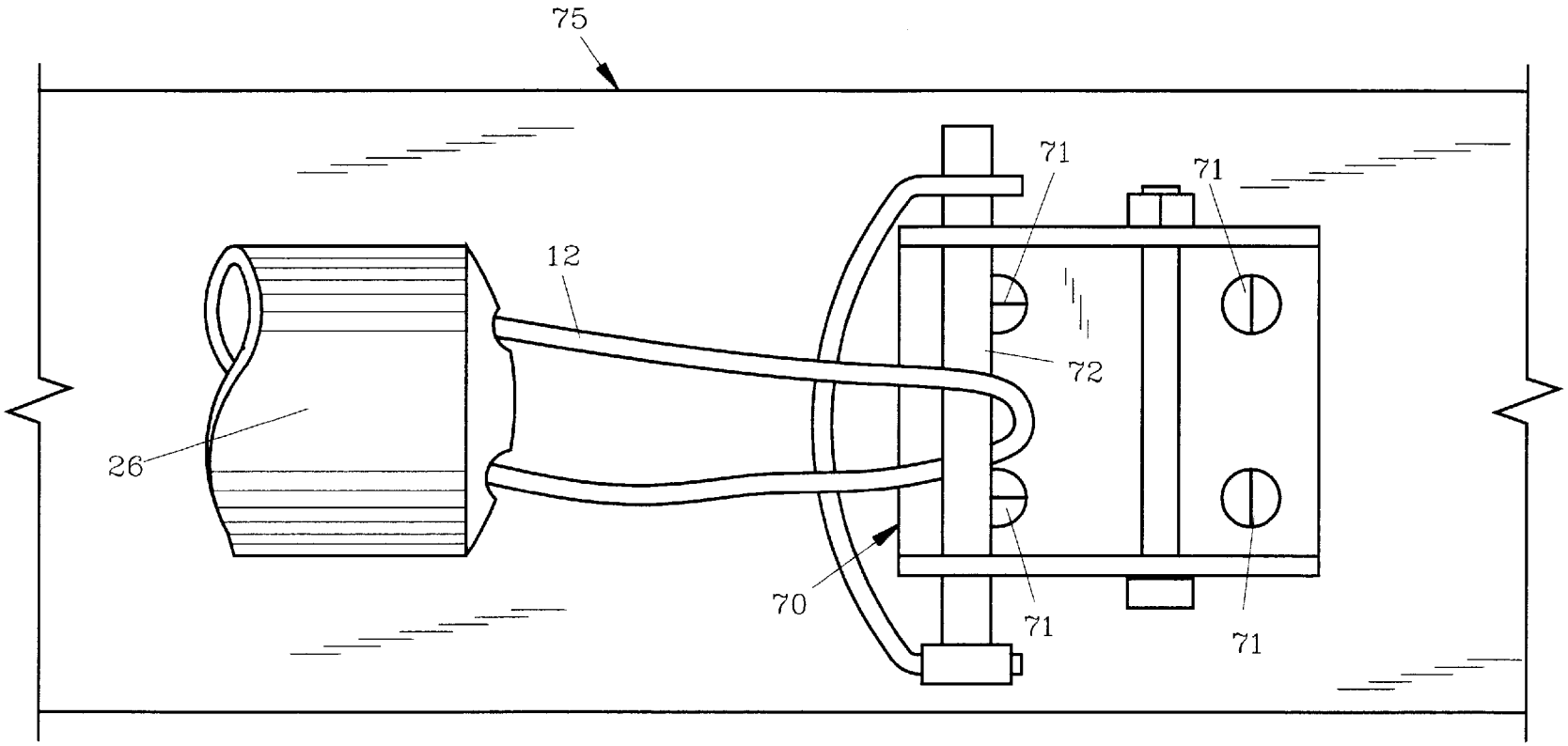
FIG. 10 illustrates an enlarged view of a mooring connector for permanent attachment, such as to a private dock.

In an alternate method of mooring a boat, such as for mooring at a boat owner's. personal dock, permanent dock connector 70 is shown in FIG. 10 which can be affixed to dock 75 by lag screws 71. Four dock connectors 70 can be mounted on a private dock for a particular boat for quicker mooring as mooring pins 72 are placed through endless cord 12 as it exits end cap 26 of mooring device 10 as seen in FIG. 10. Dock connector 70 prevents the necessity of attaching releasable brackets 34, 34' in certain instances where permanent dock connector 70 can be utilized.

The preferred method of the invention includes the steps of directing a boat such as boat 60 into a parallel alignment with the selected dock, for example dock 50 herein. Releasable brackets 34, 34' of one of the two mooring devices 10 used are then inserted between dock boards 51 as shown in FIG. 4.

Bracket loop 33 is then rotated ninety degrees by turning bracket ring 40 as shown in FIG. 4. Next, wing nut 38 is tightened against washer 37 to secure loop 33 against the bottom of dock boards 51. Locking pin 22 (FIG. 1) is thereafter released from leg 15 and section 16 is slid inwardly or outwardly of leg 15 as required to make a proper length adjustment. Once adjusted, locking pin 22 is then reinserted into coincidentally aligned holes 19, 20 and 19', 20' therealong. Next, pivotable lock clip 23 is positioned over the end of locking pin 22 to hold it in place. Endless cord 12 which passes through apertures 18, 18' (FIG. 2) of end cap 17 as shown in FIG. 1 is then separated into strands 46, 46' (see FIG. 3) and are placed around boat cleat 61 shown in FIG. 2. Split bolt 45 is then loosened and moved towards cleat 61 to tighten cord 12 thereon. Split bolt 45 is then tightened in place to hold cord 12 tightly in place. The same steps are repeated for a second mooring device 10 whereby boat is temporarily secured to dock 50 at two points (cleats) along the side of boat 60. Thereafter, the method steps can be reversed to remove mooring devices 10 from boat 60 when boat 60 is ready to be moved or used on the water.

The illustrations and examples provided herein are for explanatory purposes and are not intended to limit the scope of the appended claims.

I claim:

1. A boat mooring device comprising: a tubular member, a cord, said cord contained within said tubular member, said tubular member defining a first end, a second end, and a third end, said cord exiting said first, second and said third ends whereby a boat can be moored to said cords at two ends and the cord exiting the third end can be attached to a dock.

2. The mooring device of claim 1 wherein said cord has an endless configuration.

3. The mooring device of claim 2 further comprising a trio of end caps, one each of said end caps affixed to different ends of said tubular member, each of said end caps defining a pair of apertures, said endless cord exiting said tubular member through each of said pairs of apertures.

4. A boat mooring device comprising:

a tubular member, an endless cord, said endless cord contained within said tubular member, said tubular member defining first, second and third ends, said endless cord exiting first and second ends whereby a boat can be moored to said endless cord at one end of said tubular member and said endless cord at the other end of said tubular member can be attached to a boat dock.

5. The boat mooring device of claim 4 further comprising a releasable bracket, said releasable bracket attached to said endless cord at one end of said tubular member, said bracket for attaching to the boat dock.

6. The boat mooring device of claim 5 wherein said bracket is adjustable.

7. The boat mooring device of claim 4 further comprising an end cap, said end cap affixed to one end of said tubular member, said endless cord exiting said end cap.

8. The boat mooring device of claim 7 wherein said end cap defines a pair of apertures, said endless cord exiting said end cap through said pair of apertures.

9. The boat mooring device of claim 4 further comprising a trio of end caps, one each of said end caps affixed to different ends of said tubular member, each of said end caps defining a pair of apertures, said endless cord exiting said tubular member through each of said apertures of said trio of end caps.

10. A method of mooring a boat to a dock with a tubular member containing a cord comprising the steps of:

a) passing the cord contained within the tubular member through one end thereof;

b) passing the cord contained within the tubular member through the other end of the tubular member;

c) adjusting the length of the tubular member;

d) attaching the cord passing through one end to the boat; and e) attaching the cord passing through the other end to the dock.

11. The method of claim 10 wherein passing the cord through one end comprises the step of passing an endless cord through the end.

12. The method of claim 10 wherein attaching the cord to a boat comprises the step of attaching the cord to a boat at spaced locations along the boat.

13. The method of claim 10 wherein attaching the end of the boat to the dock comprises the step of attaching the end of the cord to a releasable bracket.

14. The method of claim 13 wherein attaching the cord to a releasable bracket comprises the step of attaching the cord to an adjustable bracket.

* * * * *